US006036579A

United States Patent [19]

Cook et al.

[11] Patent Number: 6,036,579

[45] Date of Patent: Mar. 14, 2000

[54] POLYMERIC POLISHING PAD HAVING PHOTOLITHOGRAPHICALLY INDUCED SURFACE PATTERNS(S) AND METHODS RELATING THERETO

[75] Inventors: Lee Melbourne Cook, Steelville, Pa.; David B. James, Newark, Del.; Nina G. Chechik, Hockessin, Del.; William D. Budinger, Wilmington, Del.

[73] Assignee: Rodel Inc., Newark, Del.

[21] Appl. No.: 09/005,708

[22] Filed: Jan. 12, 1998

Related U.S. Application Data

[60] Provisional application No. 60/034,492, Jan. 13, 1997.

[51] Int. Cl.[7] ..... C09K 3/14; B24B 1/00

[52] U.S. Cl. ..... 451/36; 51/298; 51/293; 451/550

[58] Field of Search ..... 51/298, 299, 300, 51/305, 293; 451/29, 36, 41, 56, 526, 550

[56] References Cited

U.S. PATENT DOCUMENTS

| | | |
|---|---|---|
| 3,504,457 | 4/1970 | Jacobsen et al. . |
| 3,905,816 | 9/1975 | Boardman et al. . |
| 3,924,520 | 12/1975 | Boardman et al. . |
| 4,137,081 | 1/1979 | Pohl . |
| 4,174,218 | 11/1979 | Pohl . |
| 4,198,238 | 4/1980 | Scheve . |
| 4,266,007 | 5/1981 | Hughes et al. . |
| 4,332,873 | 6/1982 | Hughes et al. . |
| 4,442,302 | 4/1984 | Pohl . |
| 4,456,500 | 6/1984 | Ibata . |
| 4,518,677 | 5/1985 | Pohl . |
| 4,836,832 | 6/1989 | Tumey et al. . |
| 4,927,431 | 5/1990 | Buchanan et al. . |
| 4,927,432 | 5/1990 | Budinger et al. . |
| 5,197,999 | 3/1993 | Thomas . |
| 5,209,023 | 5/1993 | Bizer . |
| 5,209,027 | 5/1993 | Ishida et al. . |
| 5,209,760 | 5/1993 | Wiand . |
| 5,212,910 | 5/1993 | Breivogel et al. . |
| 5,216,843 | 6/1993 | Breivogel et al. . |
| 5,341,799 | 8/1994 | Fifield et al. . |
| 5,381,735 | 1/1995 | Fifield et al. . |
| 5,489,233 | 2/1996 | Cook et al. . |
| 5,578,362 | 11/1996 | Reinhardt et al. . |
| 5,582,672 | 12/1996 | Follet et al. . |
| 5,766,277 | 6/1998 | DeVoe et al. . |

*Primary Examiner*—Timothy V. Eley
*Attorney, Agent, or Firm*—Konrad H. Kaeding; Kenneth A. Benson

[57] ABSTRACT

An innovative method of manufacturing polishing pads using photocuring polymers and photolithography. The photolithography enables the creation of useful surface patterns not possible with conventional machining techniques and enables the use of pad materials otherwise too soft to pattern by conventional machining techniques.

15 Claims, 4 Drawing Sheets

FIG. 3
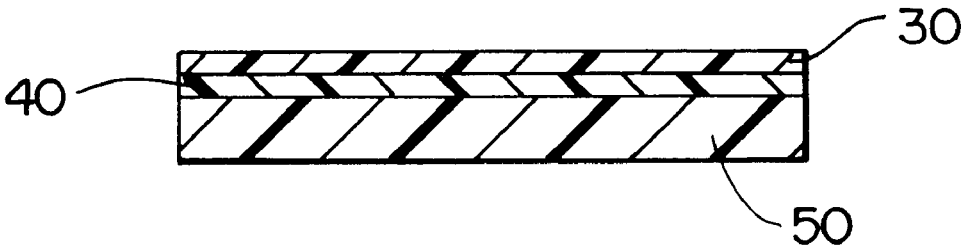
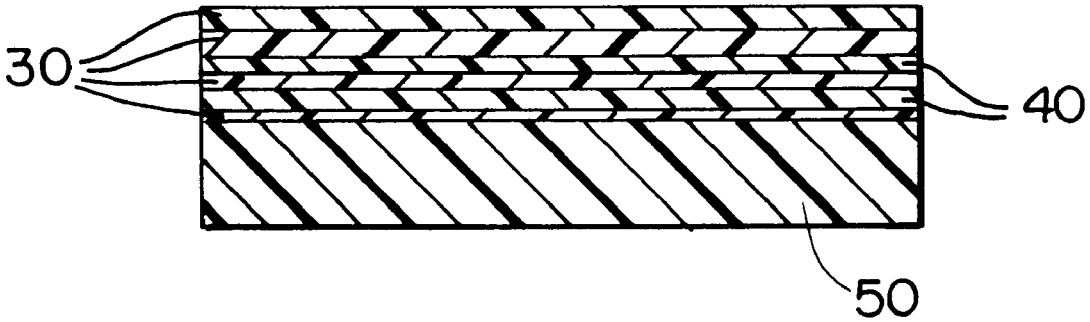
FIG. 4

POLYMERIC POLISHING PAD HAVING PHOTOLITHOGRAPHICALLY INDUCED SURFACE PATTERNS(S) AND METHODS RELATING THERETO

This application claims the benefit of U.S. Provisional Application Ser. No. 60/034,492 filed Jan. 13, 1997.

BACKGROUND OF THE INVENTION

1. Field of the Invention.

The present invention relates generally to high performance polishing is pads useful in chemica1-mechanical polishing ("CMP"); CMP is often used in the fabrication of semiconductor devices and the like. More specifically, the present invention is directed to an innovative method of manufacturing such pads using photo-curing polymers and photolithography.

2. Discussion of the Prior Art.

Broadly speaking, photolithography is known. Similarly, CMP processes are also generally known. Prior to the present invention however, it was not known how (or even if it were possible) to combine these two technical fields in a practical way to provide high performance polishing pads useful in CMP processes.

SUMMARY OF THE INVENTION

The present invention is directed to a method of manufacturing polishing pads useful in chemical-mechanical polishing ("CMP"), particularly CMP processes for planarizing silicon wafers or other substrates used In the manufacture of integrated circuit chips or the like. The pads of the present invention are particularly useful in the planarization of metals, particularly tungsten, copper, and aluminum.

The photolithography techniques of the present invention enables the creation of useful surface patterns upon materials of such softness that a surface pattern Would not otherwise be possible, using conventional mechanical surface etching, machining or similar-type conventional techniques. As a result, a whole class of high performance CMP pads are now possible for the first time on a commercial scale.

Furthermore, the lithographically induced patterns of the present invention can be more complex and better suited to particular applications than would otherwise be possible, using conventional mechanical surface etching, machining or similar-type conventional techniques; once again therefore, certain types of high performance pads are now for the first time possible on a commercial scale. The present invention enables the reliable, inexpensive manufacture of high performance pads which are capable of meeting the leading edge requirements of the semiconductor industry as it advances at an extraordinary rate.

Furthermore, since the design of the surface pattern can be readily changed in accordance with the methods of the present invention, this invention is particularly well suited to low volume production of customized patterns relative to conventional molding techniques. Pad design can be optimized for specific integrated circuit designs. Hence the present invention provides advantages over the prior art in modifying and customizing polishing pad designs, particularly on a prototyping or other similar-type low volume production.

The preferred processes of the present invention begin with a liquid precursor comprising a photoinitiator and a photo-polymerizable prepolymer or oligomer. The amount of photo-polymerizable prepolymer or oligomer (in the liquid precursor) is preferably at least about 10 weight percent, more preferably at least about 25 weight percent, yet more preferably at least about 50 weight percent and most preferably at least about 70 weight percent.

Preferably, the photo-polymerizable prepolymer or oligomer comprises a polymer backbone having photoreactive group, such as (and preferably) an acrylic or methacrylic (or a substitute derivative or an acrylic or methacrylic) functionality in an amount between 1 to 30 weight percent, more preferably between about 5 and 20 weight percent and yet more preferably about 7 to about 15 weight percent. Preferably, the photo-polymerizable prepolymer or oligomer further comprises between 15 and 65 weight percent (yet more preferably between 20 and 50 weight percent and most preferably between 25 and 45 weight percent) of a hydrophilic moiety. The preferred hydrophilic moiety is at least one member, of the group consisting of sulphone, ester, ether, urethane, amide, hydroxyl, acryl, methacryl and carboxyl. Preferred photo-polymerizable prepolymer or oligomer include acrylic or methacrylic functionalized: alkyl urethanes, polyether urethanes, polyester urethanes, polyester-ether urethanes and the like.

In an alternative embodiment of the present invention, some or all of the acrylic or methacrylic functionality of the photo-polymerizable prepolymer or oligomer is replaced with a vinyl or ethylenically unsaturated moiety.

Depending upon the particular photoreactive moiety or moieties selected in any particular embodiment of the present invention, photocuring may be possible using ultraviolet, microwave, x-ray, infra-red (or other portion of the visible spectrum), electron beam radiation or the like.

The photoinitiator can be any composition capable of producing free radicals upon exposure to the type of electromagnetic radiation (preferably ultraviolet light) used in the photopolymerization described below. Useful such photoinitiators include benzoin; alpha-hydroxymethyl benzoin; 2,2-diethoxyacetophenone; haloalkylbenzophenones; alpha, alpha, alpha-trichloroacetophenone; ketosulfides; 2-alkoxy-1,3-diphenyl-1,3-propanediene; alkyl benzoin ethers; alpha, alpha-dimethoxyphenylacetophenone; 1-phenyl-1,2-propanedione-2,0-benzyl-oxime; S,S-diphenylthiocarbonate and the like.

The liquid precursor is preferably unfilled, but can include up to 40 weight percent of other additives and fillers, such as, waxes, dyes, inert ultraviolet absorbers, polymer fillers, particulate fillers and the like. In an alternative embodiment, the liquid precursor comprises about 1 to 25 weight percent particulate filler, wherein the average size of the particulate is in the range of about 1 to about 1000 nanometers, more preferably between about 10 and 100 nanometers: examples of such particulate fillers include alumina, silica and derivations of silica, hollow orcanic micro-balloons, hollow micro-beads of glass or similar-type inorganic material, and the like.

In the method of the present invention, the precursor is caused to flow onto a photodish, filling the photodish with the liquid precursor to a height of between 0.5 and 5 millimeters, more preferably from about 1 to about 2.5 millimeters: by controlling the thickness of the final pad, it is possible to control or balance properties, such as stifffiess, resiliency and the like. "Photodish" is hereby defined as any container or support being transparent to photo-curing radiation (allowing transmission of at least 50% of incident photo-curing radiation) with respect to at least 85% of the portion of the photodish which surrounds the precursor and is of a configuration suitable for forming a CMP pad. CMP pads come in a large variety of shapes and sizes; they can be circular, oval, belts, rolls, ribbons or of virtually any shape and can have a surface area of a few square centimeters to many thousands of square centimeters. Preferably, the unstressed shape of the pad is substantially flat or planar, although non-flat or non-planar pads may be suitable for certain specialized applications.

The precursor is applied to the photodish by curtain coating, doctor blading, spin coating, screen printing, ink jet printing or any similar-type conventional or non-conventional coating technique.

The term "photomask" is intended to mean any material having varying or non-uniform barrier properties to ultra-violet light or other electromagnetic radiation used to photopolymerize the precursor. A preferred pnotormask material comprises an electromagnetic barrier material having a design which perforates (or is cut out of) the material. Upon application of electromagnetic radiation on one side of the photomask, a pattern of electromagnetic radiation is emitted from the opposite side of the photomask. The emitted pattern preferably comprises "shadow portions" (having virtually no electromagnetic radiation) and electromagnetic radiation portions; together the two portions can form an intricate pattern of electromagnetic radiation.

The photomask is applied over at least one surface of the liquid precursor and photo-curing (electromagnetic) radiation is applied to the photomask, thereby causing a pattern of electromagnetic radiation to be applied to the surface of the precursor. The photomask allows selective curing of the liquid precursor photoreactive moieties due to beams of electromagnetic radiation which penetrates through only a portion of the photomask. The resulting pattern of electromagnetic radiation which pass through the photomask creates a pattern upon the surface of the precursor by solidifying only that portion of the pad which is in the pathway of the pattern of electromagnetic radiation. In this way, the pattern of the photomask is applied to the surface of the precursor material.

In one embodiment of the present invention, multiple imaging is used, so that multiple depths can be obtained. Furthermore, multiphased compositions or multiple layers of different photo-reactive compositions can be used to provide composite structures.

Further photo-curing radiation can be used to cause photopolymerization of the precursor on the opposite (non-patterned) surface of the precursor. Such photo-curing on both sides of the precursor allows control of the depth of the pattern. Ultimately, the precursor is fully solidified by the photo-curing radiation and defines a pattern on a surface, due to the photo-curing pattern emitted through the photomask.

The patterned surface is solidified by photo-curing radiation only where electromagnetic radiation is able to penetrate through the photomask, in The shadow portion of the pattern contains virtually no electromagnetic radiation, and the surface portion upon which the shadow is cast is not solidified, i.e., is not cured or photopolymerized by the electromagnetic radiation. The non-photopolymerized portion of the surface remains liquid and is preferably washed away in a second step by a liquid carrier capable of pulling the unpolymerized precursor away from the photopolymerized portion, thereby resulting in a solidified pad having a patterned surface.

The three dimensional pattern can be any configuration, such as a divot, groove, hole, cube, cone, or any other geometric configuration. Preferably the average depth of the pattern is anywhere between about 25 microns and the entire depth of the pad, i.e., the pad can comprise holes or channels which extend through the entire pad. Also, the spacing between such geometric configurations is preferably in the range of about 0.5 to 5 millimeters. In one embodiment, the three dimensional pattern defines a series of labyrinthine pathways extending from a middle portion of the pad to a outer portion along the circumference of the pad.

Optionally, a backing is placed onto the back (non-patterned) surface of the pad. The backing can provide dimensional integrity. Additional layers may be incorporated with or without the backing to provide stiffening compressibility, elasticity or the like. The flexible backing is preferably elastomernc, such as an elastomeric urethane foam or the like.

In an alternative embodiment of the present invention, a photomask is unnecessary, because the photo-curing radiation is provided in the form of one or more lasers and/or electron beams which can be moved in such a way as to cause a pattern of radiation to be placed upon a surface of the photo-curing precursor. The resulting pattern of radiation will then cause photo-curing in accordance with such pattern.

In yet another alternative embodiment of the present invention, the precursor material is a solid, and the photo-reactivity of the precursor causes the solid precursor material to degrade when sufficiently contacted with electromagnetic radiation. In this way, the portion of the precursor which is contacted by the electromagnetic radiation is removed from the precursor to thereby create a surface pattern.

In a more preferred embodiment, the precursor comprises at least a majority amount by weight of a polyurethane pre-polymer or oligomer.

In another embodiment, the photo-curing is accomplished from above the precursor, and photo-curing radiation from below is unnecessary. Consequently, in such an embodiment, any support substrate would be appropriate and need not be a photo-curing transparent substrate, i.e., a photodish.

In another embodiment, the ratio of surface area of the pad after the creation of the three dimensional pattern divided by the surface area of the pad prior to creation of the three dimensional pattern is in the range of 1.1 to 50.

In other embodiments, the modulus of the final pad can have a range of about 1 to 200 MegaPascals, a surface energy in the range of about 35–50 milliNewtons per meter and will swell by less than 2% when immersed in 20 degree Centigrade water for 24 hours.

The pads of the present invention can be used as part of a method for polishing a substrate comprising silicon, silicon dioxide, metal or combinations thereof. Preferred substrates are those used in the manufacture of integrated circuit chips and the like, such as in the planarization of silicon wafers and the polishing or planarization of integrated circuit chip layers of silicon, silicon dioxide or metal embedded in silicon and or silicon dioxide. Preferred metals for polishing (using the pads of the present invention) include aluminum, copper and tungsten.

A pad of the present invention is preferably placed in contact with the substrate, and a water based particulate slurry is pumped onto the pad. Preferably, the slurry forms a film between the pad and substrate as the pad is moved over the substrate, typically in a circular motion. As the substrate is polished, the slurry flows through the pathways of the pad and out of the system as new slurry is pumped into the system.

The methods of the present invention are particularly advantageous for polishing applications requiring pads of a very low modulus surface material (having a 40 Shore D hardness or less), because such a pad is generally too soft for machining a pattern onto the surface of the pad. Furthermore, certain patterns available with the lithographic techniques of the present invention are not possible with conventional machining technology. Hence, the methods of the present invention allow for a whole class of intricately patterned pads which were not possible with conventional machining technology.

BRIEF DESCRIPTION OF THE DRAWINGS

FIGS. 3 and 4 illustrate multilayer pads in accordance with the present invention.

DETAILED DESCRIPTION OF THE PREFERRED EMBODIMENT(S)

In a preferred embodiment, liquid photopolymerizable precursor material comprising acrylic or methacrylic photopolymerizable polyurethane was obtained from MacDermid Imaging Technology, Inc. under the commercial designation of R260. A photomask was place at the bottom of a photodish, the photomask being a conventional, commercially available photomask having a ultraviolet light permeable (polyester) film which supports a pattern of an ultraviolet light impermeable silver halide material. A 12 micron thick polypropylene film is placed over the photomask to protect it from contamination by the precursor material.

The precursor material was poured into a photodish container (over the photomask and polypropylene film) until an overall thickness of about 1.25 millimeters was obtained; the thickness was uniform to a tolerance of about plus or minus 25 microns.

Ultraviolet light was applied to the precursor material, through the photomask. The ultraviolet light source provided an intensity of about 6–7 milliwatts per square centimeter and a wavelength of about 300 to 400 nanometers. A similar-type ultraviolet light source was then applied from above the surface of the precursor material, thereby causing photocuring of the top (non-patterned) side of the precursor material. Exposure time for the upper and lower ultraviolet light source was about 20–30 seconds from the top and about 15 seconds from the bottom. The precursor material was then rinsed in a washing solution also supplied by MacDermid Imaging Technology, Inc. (V7300). After about ten minutes, the material was again exposed to ultraviolet radiation, but this time no photomask was used. Thereafter, the solidified material was dried at about 36 degrees Centigrade. The resulting pad had the following physical properties:

1. overall thickness: 1.3 mm;
2. groove depth: 0.4 mm;
3. groove width: 0.25 mm;
4. land (top of the grooves) width: 0.50 mm;
5. pitch: 0.75 mm;
6. hardness: 44D (Shore) by ASTM D2240-91 (Standard Test Method for Rubber Properm-Durometer hardness", Published February 1992:
7. modulus: 120 MPa; and
8. density: 1.2 g/cc.

These pads were used to polish aluminum films deposited on semiconductor wafers. The pads were conditioned prior to use using industry standard procedures. Polishing was carried out using a Westech 372U polisher using typical conditions known to those skilled in the art of polishing. The pad was used in conjunction with an alumina based slurry developed by Rodel, Inc.

The pads removed aluminum at a rate greater than 5000A/min. with better than 5% non-uniformity across the wafer. The pad has a significantly higher removal rate than competitive pads (3000A/min) and has the further advantages of producing polished wafers having improved planarity, smoother surfaces and lower defects.

Figure 1:
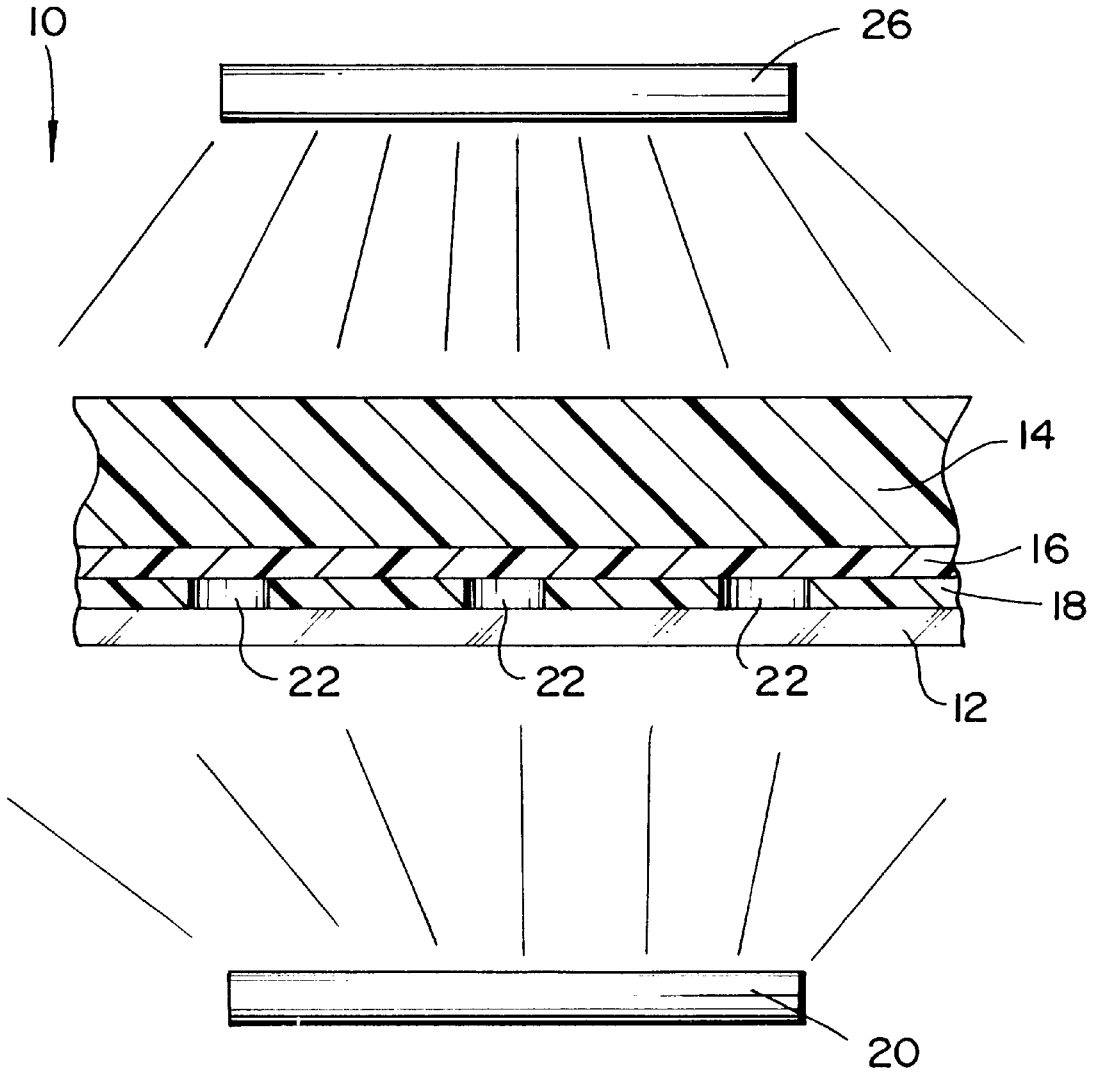
FIG. 1 is a perspective representation of electromagnetic radiation penetrating a photomask and thereby causing a photopolymerized pattern upon a precursor material in accordance with the present invention.

An illustration of the photo-polymerization and photolithography process of the present invention is shown generally at 10 in FIG. 1. The photodish 12 supports the precursor material 14. A protective polypropylene sheet 16 lies under the precursor material 14 and between the precursor and a photomask 18. A first ultraviolet light source 20 applies ultraviolet light through the photomask 18, providing a pattern of ultraviolet light upon the precursor 14, whereby the ultraviolet light passes through the photomask only at transmission openings 22. A second ultraviolet light source 26 applies ultraviolet light upon the opposite surface 24 of the precursor material.

Figure 2:
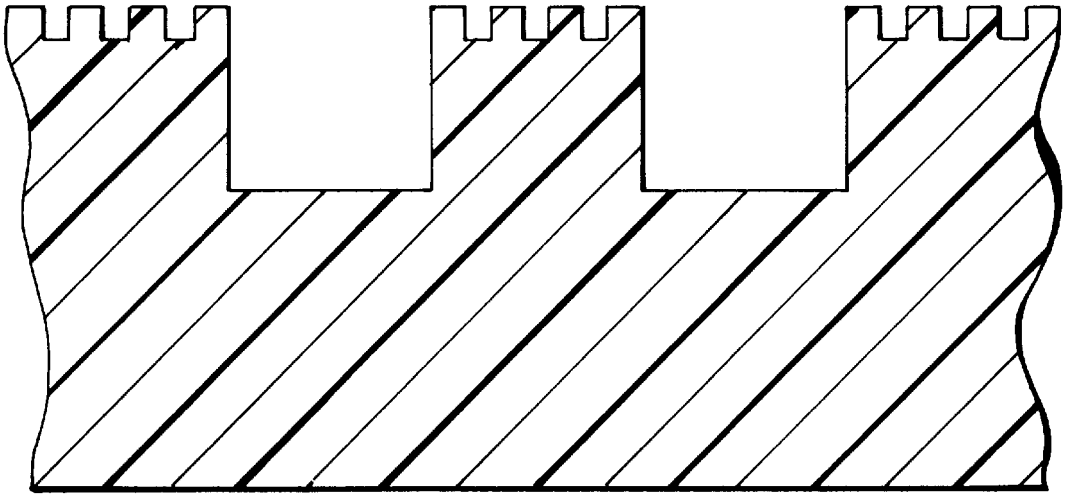
FIG. 2 is a cross-sectional view of a pad surface configuration manufactured in accordance with the present invention.
Figure 5A:
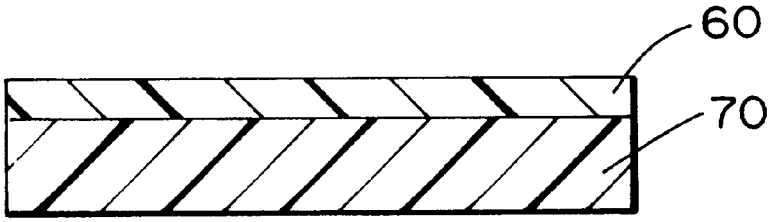
FIG. 5 illustrates a preferred method of the present invention.
Figure 5B:
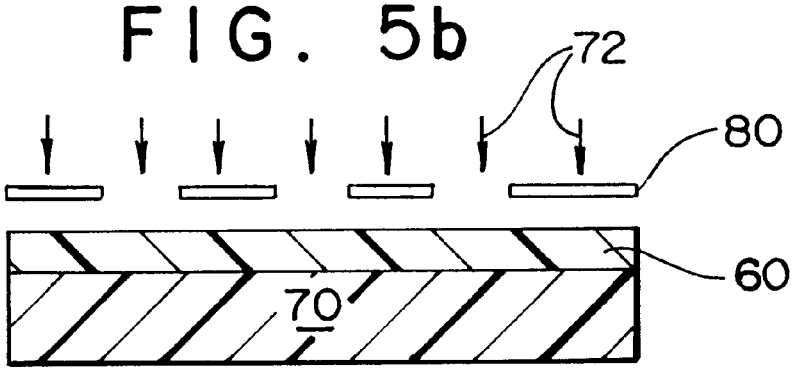
Figure 5C:
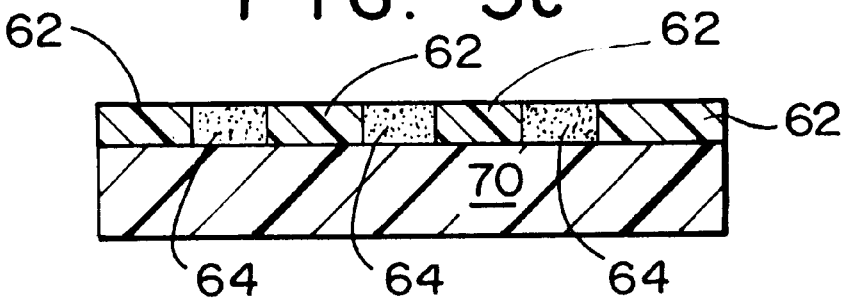
Figure 5D:
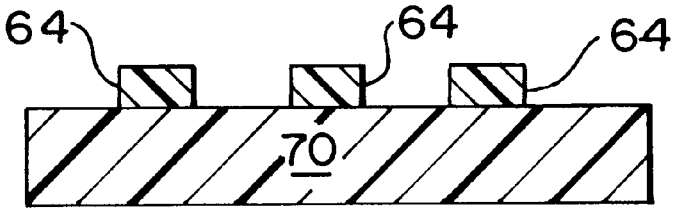

FIG. 2 illustrates a surface pattern which can be advantageously created pursuant to the present invention. The variation in groove depth can be accomplished by multiple photo-imaging. Furthermore, multiple layers are possible, so that the hardness or other physical characteristic at a top portion of a groove could be designed to be different from a bottom portion of a groove.

In an alternative embodiment, illustrated in FIGS. 3 and 4, two different reactive base polymers 30 and 40 having different properties are used to coat a substrate 50 to create a surface layer having a gradient of properties. Substrate 50 and reactive coating 40 have equivalent low hardness while coating 30 has a higher hardness. To produce the final device, coatings of each material in turn are formed and reacted as described above. This produces a fully reacted intermediate layer on top of which is applied the next layer in the desired sequence. Thus in FIG. 3, the coating materials are combined to give a simple hard top coat over two softer underlayers. In FIG. 4, multiple layers are alternated to give a step approximation to a hardness gradient in the surface.

FIGS. 5 a–d illustrate a technique for preparing a textured pad having flow channels in the surface. A reactive polymer base 60 is spread onto a substrate 70 to form a contiguous uniform surface layer. Following film formation, a mask 80 with opaque and transmissive area is placed onto or proximate to the outer surface of the layer. Upon illumination 72, the reactive polymer 60 polymerizes only where light is transmitted (64), leaving the remainder 62 of the layer in an unreacted form. Following exposure, the article is washed in an appropriate solvent to remove the unpolymerized portion of the surface layer to produce a series of flow channels in the final surface.

The present invention is not intended to be limited by any of the embodiments described above, but rather, is intended to be limited only by the claims provided below.

What is claimed is:

1. A method of polishing a substrate comprising a silicon, silicon dioxide, metal or combinations thereof:

applying a photomask to at least one surface of a liquid precursor having photoreactive moieties and curing said photoreactivc moieties of said liquid precursor, using a beam of electromagnetic radiation which penetrates through only a portion of said photomask to cause a major portion of said liquid precursor to solidify into a flexible pad having a surface pattern, a minor portion of said liquid precursor remaining unsolidified due to said photomask acting as a barrier to electromagnetic radiation penetration, removing at least a portion of said unsolidified precursor to provide a three dimensional pattern on the front surface of said flexible pad, wherein the ratio of surface area of said front surface of said flexible pad after the creation of said three dimensional pattern divided by the surface area of said front surface of said flexible pad prior to creation of said three dimensional pattern is in the range of 1.1–50:

placing said front surface of said flexible pad in contact with a substrate having a surface comprising a member of the group consisting of silicon, silicon dioxide, copper, tungsten, aluminum or a combination thereof;

pumping a water based particulate slurry into contact with said front surface of said flexible pad; and forcing the slurry between said front surface of said flexible pad and said substrate as said front surface of said flexible pad is moved over said substrate, said slurry flowing through a pathway of said three dimensional pattern of said front surface of said flexible pad which lies in a close proximity to said substrate.

2. A method in accordance with claim 1 wherein said substrate is a precursor to a integrated circuit chip.

3. A substrate polished in accordance with the method of claim 1.

4. A method of manufacturing a polishing pad comprising:

flowing a liquid precursor onto a substrate and filling said substrate with said liquid precursor to a height of between 0.5 and 5 millimeters, said liquid precursor comprising a photoinitiator and a photo-polymerizable prepolymer or oligomer, said prepolymer or oligomer having a polymer backbone, said backbone having between 1 to 30 weight percent photoreactive moieties and between 15 and 65 weight percent of hydrophilic moieties, said hydrophilic moieties being at least one member of the group consisting of ester, ether, urethane, amide, hydroxyl, acryl, methacryl and carboxyl;

applying a photomask along at least one surface of said liquid precursor and curing said plotoreactive moieties of said liquid precursor using a beam of electromagnetic radiation which penetrates through only a portion of said photomask to cause a major portion of said precursor to solidify into a flexible pad having a surface pattern, a minor portion of said precursor remaining unsolidified due to said photomask acting as a barrier to electromagnetic radiation penetration, and removing at least a portion of said minor portion of said precursor remaining unsolidified to provide a three dimensional pattern on a front surface of said flexible pad, wherein the ratio of surface area of said front surface of said flexible pad after the creation of said three dimensional pattern divided by the surface area on said front surface of said flexible pad prior to creation of said three dimensional pattern is in the range of 1.1–50.

5. A method in accordance with claim 4 further comprising the step of bonding a backing onto the back surface of said flexible pad.

6. A method in accordance with claim 4, wherein said photoreactive moieties are acryl or methacryl moieties or a derivative thereof and said substrate is a photodish.

7. A method in accordance with claim 6, wherein said liquid precursor comprises a majority amount by weight of a polyurethane pre-polymer or oligomer.

8. A method in accordance with claim 4, wherein said photoreactive moieties are vinyl moieties.

9. A method in accordance with claim 4 wherein the modulus of said flexible pad is in the range of 1–200 MegaPascal.

10. A method in accordance with claim 4 wherein said front surface of said flexible pad defines a surface energy in the range of about 35 to 50 milliNewtons per meter.

11. A method in accordance with claim 4 wherein said flexible pad will swell by less than 2% when immersed in 20 degree Centigrade water for 24 hours.

12. A method in accordance with claim 4 further comprising the step of mixing a particulate into said liquid precursor prior to curing said photoreactive moieites of said liquid precursor.

13. A polishing pad made in accordance with the method of claim 4.

14. A method of manufacturing a polishing pad in accordance with claim 1, further comprising a second photo-imaging step to provide a second pattern upon the pad surface, the second pattern having a depth which is different than that of the first pattern.

15. A method of manufacturing a polishing pad comprising:

flowing a liquid precursor onto a pohotodish and filling said photodish with said liquid precursor to a height of between 0.5 and 5 millimeters, said photodish being transparent to ultraviolet light, said liquid precursor comprising a photoinitiator and a photo-polymerizable prepolyrner or oligomer, said prepolymer or oligomer having a polymer backbone, said backbone having between 1 to 30 weight percent photoreactive moieties and between 15 and 65 weight percent of hydrophilic moieties, said hydrophilic moieties being at least one member of the group consisting of ester, ether, urethane, amide, hydroxyl, acryl, methacryl and carboxyl;

applying a laser beam induced pattern of electromagnetic radiation to at least one surface of the liquid precursor and thereby curing said photoreactive moieties of said liquid precursor to create a pattern upon the precursor material.

* * * * *